US007459045B2

(12) United States Patent
Hwang et al.

(10) Patent No.: US 7,459,045 B2
(45) Date of Patent: Dec. 2, 2008

(54) MACHINE FOR SEALING A CRYOTUBE WITH A FILM

(75) Inventors: Shiaw-Min Hwang, Hsinchu (TW); I-Ting Kao, Hsinchu (TW); Hsin-I Chen, Hsinchu (TW); Chen-Der Tsai, Hsinchu (TW); Hann-Tsong Wang, Hsinchu (TW)

(73) Assignee: Food Industry Research and Development Institute, Hsinchu (TW)

( * ) Notice: Subject to any disclaimer, the term of this patent is extended or adjusted under 35 U.S.C. 154(b) by 479 days.

(21) Appl. No.: 11/144,650

(22) Filed: Jun. 6, 2005

(65) Prior Publication Data

US 2006/0137824 A1 Jun. 29, 2006

(30) Foreign Application Priority Data

Dec. 24, 2004 (TW) ..... 93220802 U

(51) Int. Cl.
*B32B 37/00* (2006.01)

(52) U.S. Cl. ..... 156/64; 156/82; 156/86; 156/368; 156/497; 156/499

(58) Field of Classification Search ..... 156/64, 156/82, 158, 363, 497, 499, 502, 503, 69, 156/84, 85, 86, 368
See application file for complete search history.

(56) References Cited

U.S. PATENT DOCUMENTS 4,514,242 A * 4/1985 MacLaughlin et al. ..... 156/73.5
4,793,880 A * 12/1988 Shaposka et al. ..... 156/158
5,395,336 A * 3/1995 Barclay et al. ..... 604/103

* cited by examiner

*Primary Examiner*—James Sells
(74) *Attorney, Agent, or Firm*—Bacon & Thomas, PLLC

(57) ABSTRACT

A machine for sealing a cryotube with a thermoplastic film, which is heated and shrunk, is disclosed. The cryotube has a cap with threads, a tube body and a tubular thermoplastic film, wherein the cap is threadably connected to an open end of the tube body and the thermoplastic film is received by the cap and the tube body at the connection thereof. The machine includes a holder for holding the cryotube, a rotation mechanism for rotating the cryotube around a longitudinal axis of the cryotube, and a heating mechanism for heating the thermoplastic film of the cryotube hold in the holder, so that the thermoplastic film shrinks.

5 Claims, 5 Drawing Sheets

MACHINE FOR SEALING A CRYOTUBE WITH A FILM

FIELD OF THE INVENTION

The present invention relates to a machine for sealing a cryotube with a film, and particularly to a machine for sealing a cryotube with a thermoplastic film through heating the thermoplastic film to shrink.

BACKGROUND OF THE INVENTION

A manner for long term preserving biologic samples (including microbe, cell, tissue, spermatozoon and so on) includes mixing the sample with a cryo-culture medium, distributing the mixture to a cryotube or a cryovial and then putting the cryotube into a liquid nitrogen tank for storage at −196° C. A cap of the cryotube and a tube body of the cryotube have different degrees of thermal expansion and contraction due to the structure and material difference therebetween, when the cryotube are immerged into the liquid nitrogen. As a result, the liquid nitrogen is liable to invade into the tube body of the cryotube, which not only contaminates the biologic sample, but a gas explosion may also occur due to rapid vaporization of the liquid nitrogen in the tube body of the cryotube when the cryotube is taken out from the liquid nitrogen tank.

A commercially available thermoplastic film which is made from polyethylene (PE) can be used in for the long term storage at the temperature of the liquid nitrogen. In use, the translucent tubular PE film is cut in a desired length, is put on the cryotube and then is heated directly by intense heat flame of a gas gun or a small torch gun. The PE film shrinks for being heated and tightly seals the cryotube, thereby preventing the problems of contamination, and gas explosion caused by the invasion of the liquid nitrogen. However, the sealing process is done by an experienced operator manually, which is time consuming and laborious. Furthermore, quality of the sealing process varies and the chance of failure in the sealing process is high, which is about 40% for one of the inventors of the present invention. Further, if the heating time is too long during the sealing process due to inexperience or neglect of an operator, the biologic sample in the cryotube may be destroyed due to the overheating, or even the cryotube may be damaged. Therefore, the thermoplastic film sealing process is waived for most of the cryotube storage, and thus the problems caused by the migration of the liquid nitrogen into the cryotube are not solved.

SUMMARY OF THE INVENTION

Accordingly, an object of the present invention is to provide a machine for sealing a cryotube with a film through heating a thermoplastic film to shrink.

Another object of the present invention is to provide a machine for sealing a cryotube with a film, which has a control unit for automatically heating a thermoplastic film to shrink and seal the cryotube.

A cryotube suitable for use in the present invention comprises a tube body, a cap threadedly engaging with an open end of the tube body, and a tubular thermoplastic film received at the joint of the cap and the tube body.

In order to accomplish the objects of the present invention, a machine for sealing a cryotube with a film constructed according to the present invention comprises a holder adapted to hold the cryotube, wherein a bottom opposite to the open end of the tube body is to be hold in the holder while the cap and the thermoplastic film extend out from the holder;

a rotation mechanism for driving the holder to rotate around a longitudinal axis of the cryotube hold in the holder; and a heating mechanism for heating the thermoplastic film of the cryotube hold in the holder, so that the thermoplastic film shrinks.

Preferably, the machine of the present invention further comprises a control unit for controlling start of the rotation mechanism and start of the heating mechanism so that the thermoplastic film of the cryotube hold in the holder is heated for a predetermined time by the heating mechanism while the holder is rotating.

Preferably, the machine of the present invention further comprises a conveying mechanism for conveying the holder and the rotation mechanism from a working position to a heating position and from the heating position to the working position, wherein at the heating position, the cryotube hold in the holder locates at such a position that the thermoplastic film is able to be heated by the heating mechanism. More preferably, the machine of the present invention further comprises a control unit for controlling start of the rotation mechanism, start of the heating mechanism and start of the conveying mechanism, so that the holder and the rotation mechanism are conveyed from the working position to the heating position by the conveying mechanism, the thermoplastic film of the cryotube hold in the holder is heated for a predetermined time by the heating mechanism while the holder is rotating, and then the holder and the rotation mechanism are conveyed from the heating position to the working position by the conveying mechanism after the heating is finished.

Preferably, the holder is of heat insulation.

Preferably, the heating mechanism blows hot wind to heat the thermoplastic film.

By using the machine of the present invention, a cryotube can be easily sealed with a film with consistent quality for preventing liquid nitrogen from migrating into the cryotube, thereby assuring the storage quality and safe thaw.

Other objects, advantages, and novel features of the invention will become more apparent from the following detailed description when taken in conjunction with the accompanying drawings.

DESCRIPTION OF THE PREFERRED EMBODIMENT

Figure 4:
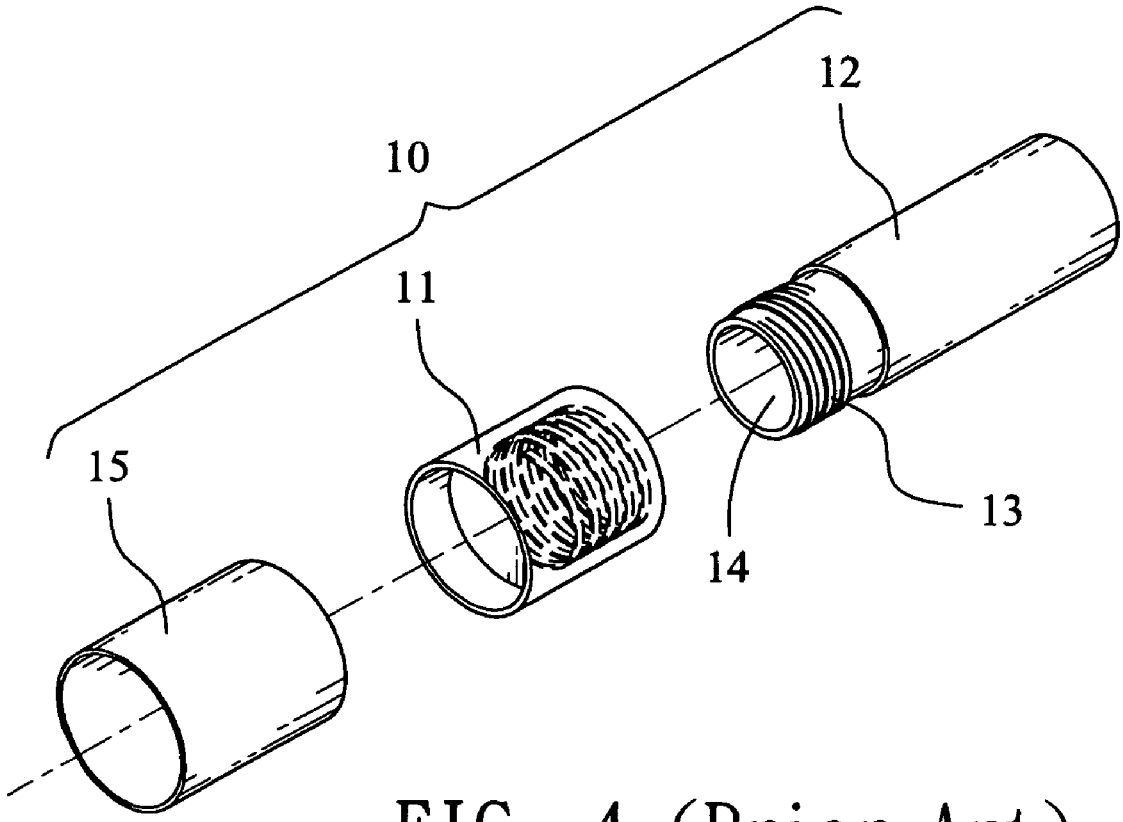
FIG. 4 (Prior Art)
FIG. 4 is an exploded view of a cryotube used in the present invention.
Figure 5:
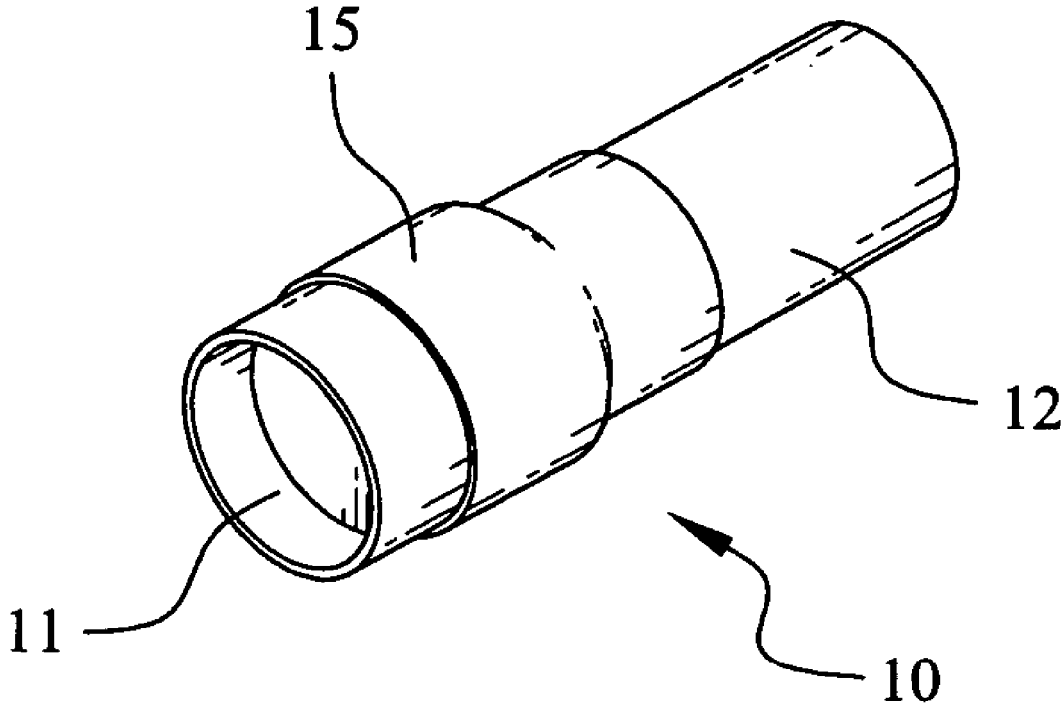
FIG. 5 (Prior Art)
FIG. 5 is an assembled view of the cryotube shown in FIG. 4.

Referring to FIG. 4, a cryotube 10 used in the present invention includes a tube body 12 with a length of 4.3 cm and an external diameter of 1.1 cm; a cap 11 with a length of 1.5 cm and an inside diameter of 1.3 cm; and a tubular thermoplastic film 15 with a length of 1.5 cm and an inside diameter of 1.4 cm. The cap 11 has threads therein. An outer surface of an open end of the tube body 12 is provided with threads 13 corresponding to the threads of the cap 11. Therefore, the cap 11 is threadably connected to the open end of the tube body 12 thereby covering an opening 14 of the tube body 12. The tubular thermoplastic film 15 is made from polyethylene (PE) which is resistant to the temperature of the liquid nitrogen and can be used for a long term, for example the one available from Nunc company, US, under the trademark of Cyroflex™ and catalog No. 343958. The tubular thermoplastic film 15 is received at the joint of the cap 11 and the tube body 12, which can be heated to shrink, thereby tightly seal the joint of the cap 11 and the tube body 12, as shown in FIG. 5.

Figure 1:
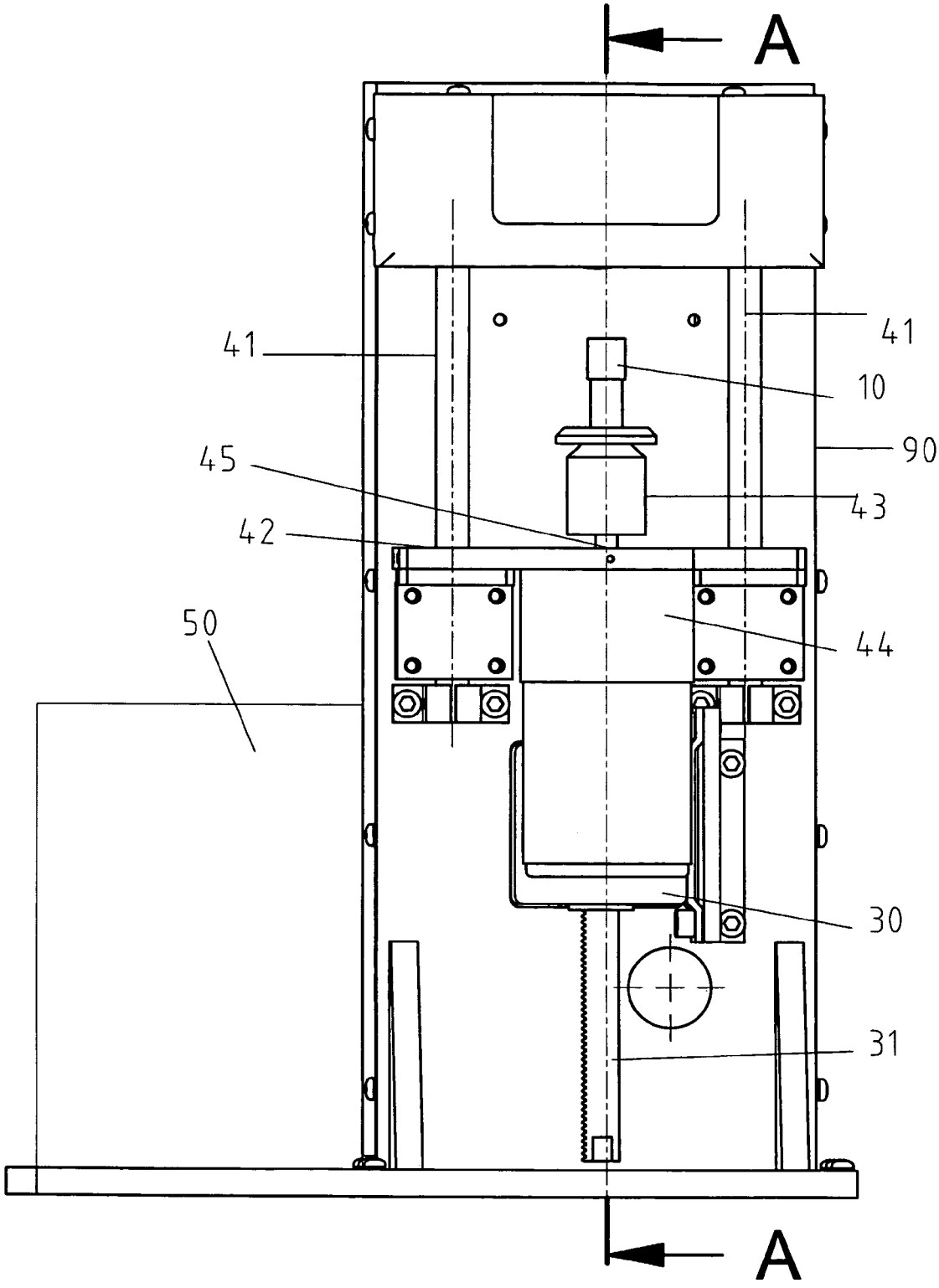
FIG. 1 is a front elevational view of a machine for sealing a cryotube with a film in accordance with a preferred embodiment of the present invention.
Figure 2:
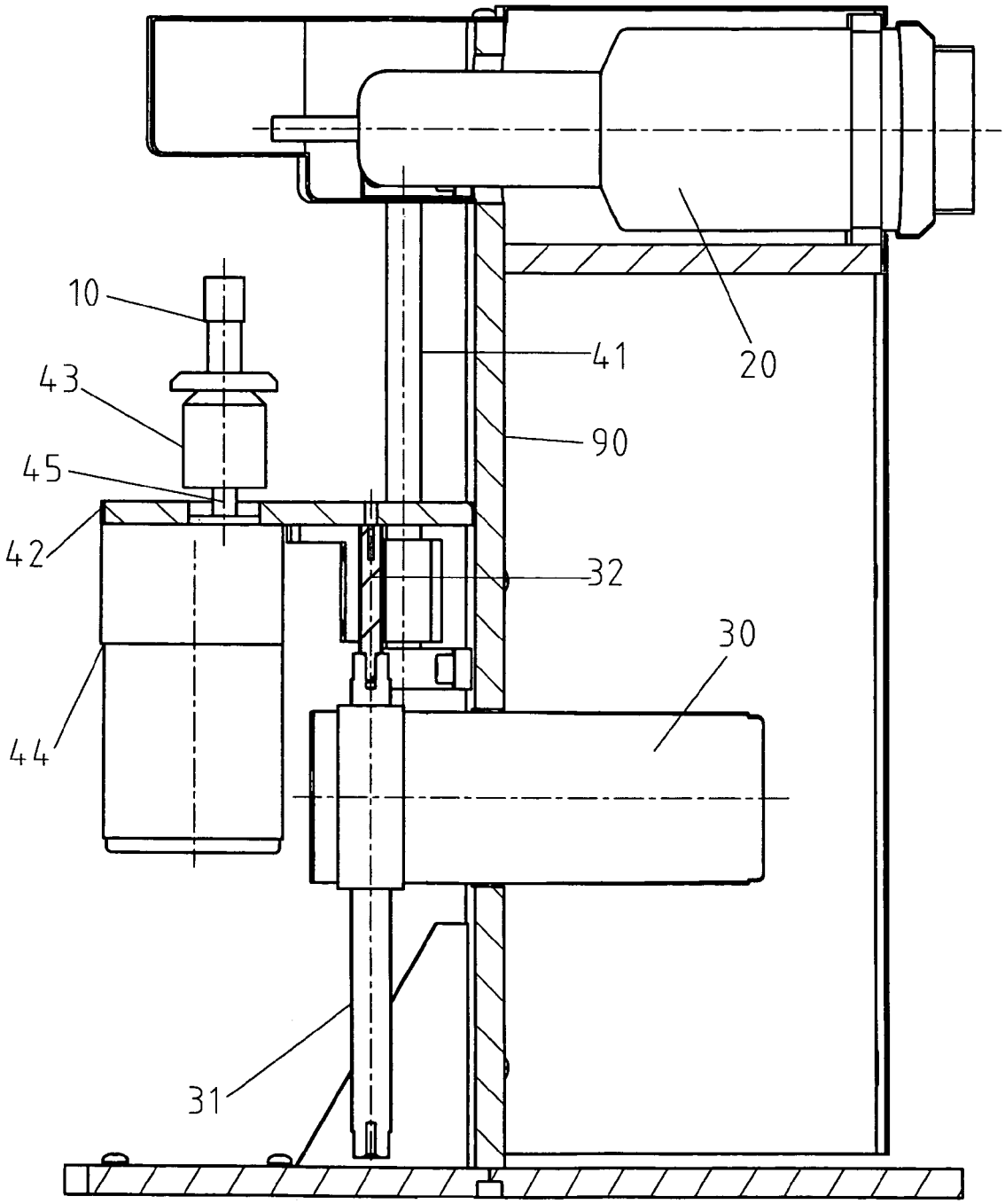
FIG. 2 is a cross-sectional view of FIG. 1 taken along line A-A.
Figure 3:
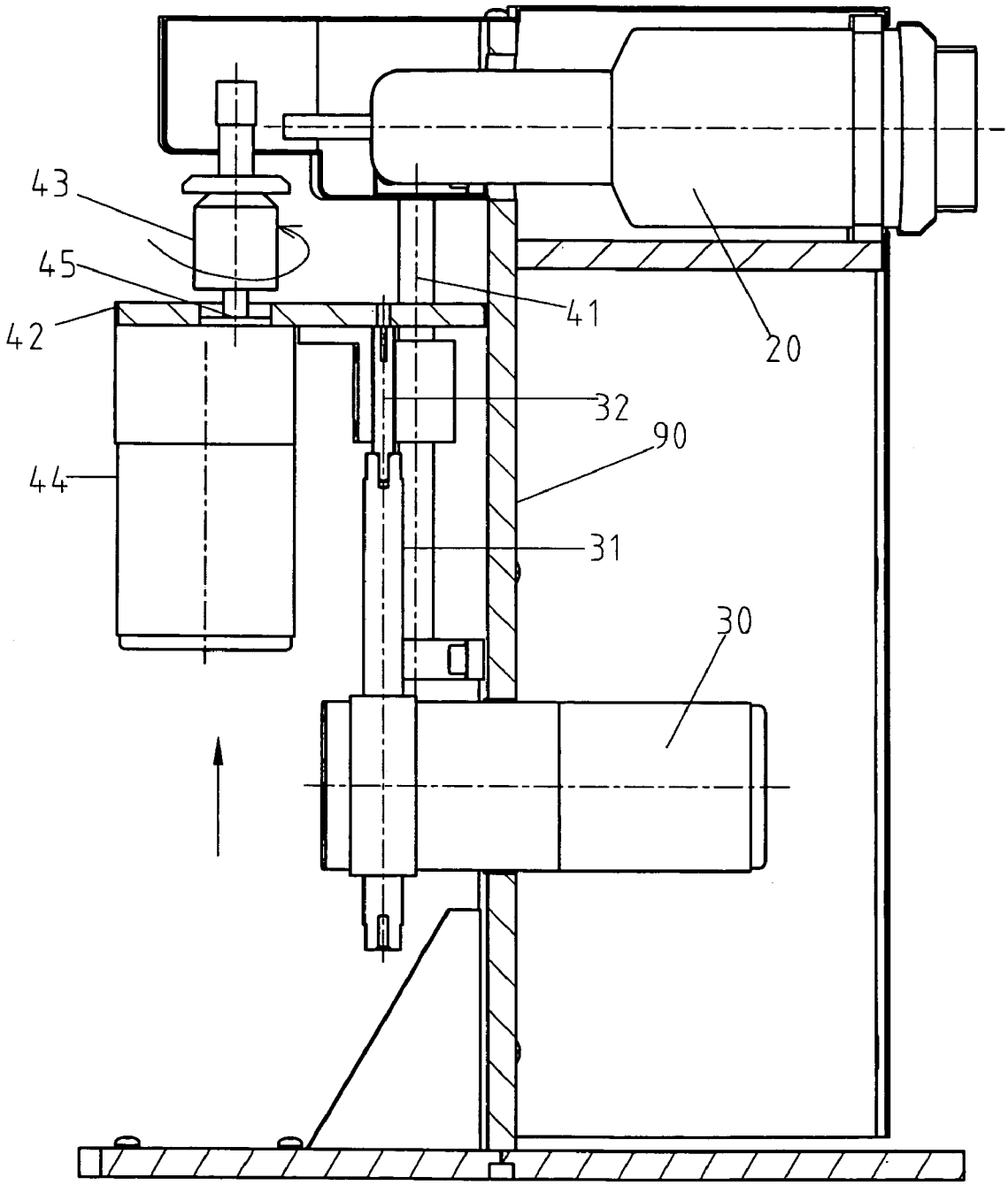
FIG. 3 is similar to FIG. 2 but showing the machine performing heating operation.

Referring to FIGS. 1-3, a machine for sealing a cryotube with a film in accordance with a preferred embodiment of the present invention includes a machine frame body 90; a hot wind blowing device 20 fixed at the top of the machine body 90; a conveying motor 30 fixed at the bottom of the machine frame body 90; a rack 31 driven by the conveying motor 30 to move up and down; a pair of sliding shafts 41 fixed at the machine frame body 90 and disposed between the hot wind blowing device 20 and the conveying motor 30; a platform 42 slidably disposed at the pair of sliding shafts 41 and having a link lever 32 at the bottom surface thereof to connect the top end of the rack 31, whereby the platform 42 is movable up and down along the sliding shafts 41 through the driving of the conveying motor 30 and the rack 31; a rotation motor 44 fixed at the bottom surface of the platform 42 with a rotation shaft 45 thereof protruding from the top surface of the platform 42; and a holder 43 fixed at the rotation shaft 45. The bottom of the tube body 12 of the cryotube 10 is vertically hold in the holder 43, while the cap 11 and the thermoplastic film 15 are protruding from the holder 43. An axis of the rotation shaft 45 and a longitudinal axis of the cryotube 10 are aligned. Therefore, when the rotation motor 44 is driven, the holder 43 and the cryotube 10 hold in the holder rotate around the longitudinal axis of the cryotube 10.

Operation steps of the machine for sealing a cryotube with a film of the present invention are described as follows:

a) providing the cryotube 10 with the cap thereof being threadedly engaged to the tube body and with the thermoplastic film being received thereon, and placing the cryotube 10 in the holder 43 made of a heat insulation material (as shown in FIGS. 1 and 2), wherein the holder 43 is at a working position facilitating an operator to work;

b) starting the conveying motor 30 to convey the rotation motor 44 and the holder 43 from the working position to a heating position through the rack 31, the link lever 32 and the platform 42, and keeping the rotation motor 44 and the holder 43 at the heating position for a predetermined time (as shown in FIG. 3);

c) starting the rotation motor 44 to rotate the holder 43 so that the thermoplastic film 15 heated in the following step can evenly shrink;

d) starting the hot wind blowing device 20 to provide hot wind with the temperature of 160° C. for heating the thermoplastic film 15 of the cryotube, so that the thermoplastic film 15 rapidly shrinks and tightly seals the joint of the cap 11 and the tube body 12 (as shown in FIG. 5);

e) stopping the hot wind blowing device 20 and the rotation motor 44 in accordance with the predetermined time, and then starting the conveying motor 30 to convey the rotation motor 44 and the holder 43 from the heating position to the working position; and f) taking out the cryotube sealed with the thermoplastic film from the holder 43.

The above steps b)-f) can be carried out through a control unit 50 disposed at a side of the machine frame body 90. The control unit 50 has a control circuit therein and the control circuit is electrically connected with the conveying motor 30, the rotation motor 44 and the hot wind blowing device 20, respectively. Therefore, through starting/stopping the conveying motor 30, the rotation motor 44 and the hot wind blowing device 20 in accordance with the configuration of the control circuit, the above steps b)-f) are automatically accomplished.

Alternatively, the sealing machine as shown in FIGS. 1-3 is devoid of the conveying motor 30, the rack 31 and the link lever 32. The platform 42 is fixedly mounted. The hot wind blowing device 20 is adjusted to locate at such a position that the thermoplastic film 15 of the cryotube hold in the holder 43 can be heated by the hot wind blowing device 20.

The present invention not only can prevent the liquid nitrogen from migrating into the cryotube, but also prevent water from migrating into the cryotube when the cryotube is immerged in a water bath for rapid thaw.

Although the present invention has been explained in relation to its preferred embodiment, it is to be understood that many other possible modifications and variations can be made without departing from the spirit and scope of the invention as hereinafter claimed.

What is claimed is:

1. A machine for sealing a cryotube with a film, wherein the cryotube comprises a tube body, a cap threadedly engaging with an open end of the tube body, and a tubular thermoplastic film received at the joint of the cap and the tube body, the machine for sealing a cryotube with a film comprising:

a holder adapted to hold the cryotube, wherein a bottom opposite to the open end of the tube body is to be held in the holder while the cap and the thermoplastic film extend out from the holder;

a rotation mechanism for driving the holder to rotate around a longitudinal axis of the cryotube held in the holder;

a heating mechanism for heating the thermoplastic film of the cryotube held in the holder, so that the thermoplastic film shrinks;

a conveying mechanism that conveys the holder and the rotation mechanism from a working position to a heating position and from the heating position to the working position, wherein at the heating position, the cryotube held in the holder is positioned such that the thermoplastic film is heated by the heating mechanism; and a control unit for controlling a start of the rotation mechanism, a start of the heating mechanism and a start of the conveying mechanism, so that the holder and the rotation mechanism are conveyed from the working position to the heating position by the conveying mechanism, the thermoplastic film of the crvotube held in the holder is heated for a predetermined time by the heating mechanism while the holder is rotating, and then the holder and the rotation mechanism are conveyed from the heating position to the working position by the conveying mechanism after the heating is finished.

2. The machine as claimed in claim 1, wherein the holder is of heat insulation.

3. The machine as claimed in claim 1, wherein the heating mechanism blows hot wind to heat the thermoplastic film.

4. The machine as claimed in claim 2, wherein the heating mechanism blows hot wind to heat the thermoplastic film.

5. A method for sealing a cryotube with a film comprising the steps of:

providing a cryotube with a cap being threadedly engaged to the tube body and with a thermoplastic film being received thereon, and placing the cryotube in a holder at a working position;

starting a conveying motor to convey a rotation motor and the holder from the working position to a heating position and keeping the rotation motor and the holder at the heating position for a predetermined time;

starting the rotation motor to rotate the holder so that the thermoplastic film heated in the following step can evenly shrink;

starting the hot wind blowing device to provide hot wind for heating the thermoplastic film of the cryotube, so that the thermoplastic film rapidly shrinks and tightly seals the joint of the cap and the tube body;

stopping the hot wind blowing device and the rotation motor in accordance with the predetermined time, and then starting the conveying motor to convey the rotation motor and the holder from the heating position to the working position.

* * * * *